US007963241B2

(12) United States Patent
Srinivasan

(10) Patent No.: US 7,963,241 B2
(45) Date of Patent: Jun. 21, 2011

(54) DRY TREE SEMI-SUBMERSIBLE PLATFORM FOR HARSH ENVIRONMENT AND ULTRA DEEPWATER APPLICATIONS

(76) Inventor: Nagan Srinivasan, Houston, TX (US)

( * ) Notice: Subject to any disclaimer, the term of this patent is extended or adjusted under 35 U.S.C. 154(b) by 164 days.

(21) Appl. No.: 12/378,888

(22) Filed: Feb. 19, 2009

(65) Prior Publication Data

US 2009/0205554 A1 Aug. 20, 2009

Related U.S. Application Data

(60) Provisional application No. 61/029,565, filed on Feb. 19, 2008.

(51) Int. Cl.
*B63B 35/44* (2006.01)

(52) U.S. Cl. ..... 114/267

(58) Field of Classification Search ..... 114/256–267; 405/201, 203–207, 210, 195.1, 224.2
See application file for complete search history.

(56) References Cited

U.S. PATENT DOCUMENTS

| | | | | |
|---|---|---|---|---|
| 2,398,351 | A | 4/1946 | Baker | |
| 4,127,004 | A | 11/1978 | Vilain | |
| 5,403,124 | A | 4/1995 | Kocaman et al. | |
| 5,707,178 | A | 1/1998 | Srinivasan | |
| 6,652,192 | B1 * | 11/2003 | Xu et al. | 405/195.1 |
| 6,761,124 | B1 | 7/2004 | Srinivasan | |
| 6,854,411 | B2 * | 2/2005 | Ankarsward | 114/265 |
| 6,899,492 | B1 * | 5/2005 | Srinivasan | 405/205 |
| 6,942,427 | B1 | 9/2005 | Srinivasan | |
| 7,219,615 | B2 * | 5/2007 | Merchant et al. | 114/265 |
| 7,413,384 | B2 * | 8/2008 | Horton et al. | 405/224.2 |
| 7,537,416 | B2 * | 5/2009 | Wetch | 405/224.2 |
| 2005/0175414 | A1 | 8/2005 | Abbott et al. | |
| 2005/0217554 | A1 | 10/2005 | Steen | |

FOREIGN PATENT DOCUMENTS

| | | | |
|---|---|---|---|
| JP | 58218521 | A | 12/1983 |
| JP | 59161521 | A | 9/1984 |

* cited by examiner

*Primary Examiner* — Daniel V Venne
(74) *Attorney, Agent, or Firm* — Kenneth A. Roddy

(57) ABSTRACT

Column-stabilized floating offshore platform structures (10) having spaced apart buoyant main vertical columns (11) joined at lower ends by horizontal lower truss members (13) in a pin connection and joined at upper ends by a buoyant deck mount structure (14), and/or by horizontal truss members, to form a moment connection. A buoyant keel tank (15) having a central moon pool (15A) can be retracted and extended relative to the main columns between a retracted transport mode and an extended operating mode. Ballast of the columns and keel tank can be adjusted to raise or lower the center of gravity of the structure with respect to its center of buoyancy to stabilize the structure and compensate for variable or fixed loads, deck payloads, environmental conditions, and operational and installation stages. A three-sided deck mount allows on-site float-over deck installation.

22 Claims, 13 Drawing Sheets

DRY TREE SEMI-SUBMERSIBLE PLATFORM FOR HARSH ENVIRONMENT AND ULTRA DEEPWATER APPLICATIONS

CROSS REFERENCE TO RELATED APPLICATION

This application claims priority of U.S. Provisional Application Ser. No. 61/029,565, filed Feb. 19, 2008.

BACKGROUND OF THE INVENTION

1. Field of the Invention

This invention relates generally to offshore floating vessels and platform structures used in the exploration and production of oil and gas products, and more particularly to an offshore floating platform structure having vertical columns connected at a lower end by lateral trusses, a telescoping keel tank supported beneath the columns, and a rectangular ring-like deck mount structure or a three-sided deck mount structure at the top of the columns open on one side to allow on-site float-over deck installation.

2. Brief Description of the Prior Art

In the following discussion the term "truss", as used herein, refers to a welded or bolted cross braced open frame structure formed of slender tubular members. A truss bridges between vertical column structures to stabilize a semi-submersible vessel at the water surface when floating with respect to wind, wave, current and other horizontal loads. As used herein, the term "moment connection" means a connection designed to transfer moment as well as axial and shear forces between connecting members. The term "pin connection" means a connection designed to transfer axial and shear forces between connection members, but not moments.

Floating vessels and semi-submersible floating vessels, such as floating production platforms, storage and offloading vessels, tension leg platforms (TLPs) and SPAR structures, are commonly used for oil well drilling, oil production and living and working quarters. It is desirable to design floating structures with minimum heave (vertical) oscillations to waves in the ocean environment.

Conventional column-stabilized semi-submersible vessel or platforms typically comprise three or more large diameter vertical columns that are spatially separated and connected at their bottom ends by large horizontal pontoons. The columns and pontoons of modern semi-submersibles are usually constructed of shells formed of thin metal plates backed with welded stiffeners, frames, stringers, bulkheads and stiffeners and may have compartments or voids for ballast and storage. The deck structure is above the water with a sufficient distance between the still water level to the bottom of the deck to allow waves to pass across the columns without impacting on the bottom of the deck. The center of gravity of the entire semi-submersible vessel is generally high due to large deck loads above the water. The columns and the pontoons provide stability and the necessary upward buoyancy required to support the structure, the downward payload of the deck and equipment, and live loads. The center of gravity (CG) of a conventional semi-submersible vessel is usually maintained above the center of buoyancy (CB), unlike a SPAR structure. The center of gravity (CG) positioning controls the roll and pitch period of the vessel and also the vessel stability. Due to the shallow draft of the columns, bringing the center of gravity (CG) below the center of buoyancy (CB) demands a large amount of ballast compensation in the pontoons, in addition to the buoyancy required to support the deck. Thus a conventional semi-submersible requires large water displacement to support the deck payload. Other problems with conventional semi-submersible platforms is that they are not well suited for dry tree support because their heave oscillation varies from a small magnitude in calm sea or small wave conditions to large in stormy rough sea or high wave conditions, the added mass and ballast mass of the pontoon is too large to effectively shift the natural period away from the calm wave period, and damping is very poor and predominantly radial in nature. Thus, the conventional semi submersible platforms may be acceptable for dry-tree support in low and moderate sea states but not in extreme sea states.

A conventional semi-submersible structure is structurally stable in severe wave environment due to the fact that the conventional boxed shell pontoons, either all around or on two sides, provide the vessel with a strong "moment connection" at the bottom of the columns at their bottom ends. The deck structure is typically simply supported or placed at the top of the columns and is a hinge or "pin connection" at the top of the columns and has no capacity to transfer moment to the columns through the connection. In the conventional semi-submersible, the pontoon predominantly provides the required buoyancy and the columns are separated and sized for column stabilized requirements. The pontoon mass is also large to accommodate a large volume of ballast water required to lower the center of gravity (CG) sufficiently to provide adequate stability in extreme sea conditions.

The wave forces are large on the pontoon because the large volume and mass is located at a shallow draft. Thus, the moment connection at the bottom between the columns and the pontoon are subjected to these wave forces and the connection is also subjected to severe storm loadings and fatigue loadings.

My previous U.S. Pat. No. 6,671,124, which is hereby incorporated herein by reference, discloses column-stabilized floating structures having a plurality of vertical buoyant caissons bridged together in distantly spaced relation by a plurality of open frame horizontal truss pontoon members and vertical truss columns at a lower end. A work deck is secured to the top ends of the vertical caissons. The buoyancy of the caissons is selectively adjusted by means of ballast control. Water is selectively pumped into or out of keel tanks at the bottom of the truss structure such that the water mass and weight is adjustably tuned to raise or lower the center of gravity of the entire mass of the floating structure relative to its center of buoyancy.

My previous U.S. Pat. No. 6,899,492, which is hereby incorporated herein by reference, discloses jacket frame floating structures comprising one or more elongate vertical support columns formed of an open cross-braced jacket formwork of tubular members interconnected together and at least one cylindrical buoyancy capsule disposed in the open framework near an upper end and at least one cylindrical second buoyancy capsule near a lower end in vertically spaced relation. The buoyancy capsule(s) may be a single, or a plurality of upper and lower capsules bundled in circumferentially spaced relation with a central opening therethrough. Alternatively, a keel tank may replace the lower capsule. The buoyancy of the upper buoyancy capsule(s) is adjustably tuned to provide a buoyant force and a sufficient water plane area and moment of inertia required for stability of the floating structure, and the water mass and weight of the lower buoyancy capsule(s) or keel tank(s) is adjustably tuned to raise or lower the center of gravity of the entire mass of the floating structure with respect to its center of buoyancy.

My previous U.S. Pat. No. 6,942,427, which is hereby incorporated herein by reference, discloses floating offshore fluid storage caisson platforms having a large diameter vertically oriented buoyant column or caisson, or multiple caissons, defining a storage chamber, and a telescopic keel tank disposed at the bottom end thereof, and may have deck on top of the caisson(s). The structure can be transported horizontally either dry on a transporting vessel or towed with its keel tank in a fully retracted position. At the field of operation, the structure initially floats horizontally. The keel tank is extended and then slowly flooded to move the center of gravity of the structure toward the keel tank and with the heavier tank, the structure tilts upright to assume an operating vertical position with the telescopic keel tank extended downward with respect to the caisson, and thereafter as the storage chamber is filled with fluid, the relative position of the keel tank is adjustably tuned to raise or lower the center of gravity of the entire mass of the structure with respect to its center of buoyancy and maintain the center of gravity of the structure below its center of buoyancy and stabilize the structure vertically at a desired draft.

SUMMARY OF THE INVENTION

The present invention overcomes the aforementioned problems and is distinguished over the prior art by column-stabilized floating offshore platform structures having buoyant main vertical columns bridged together in spaced apart relation by horizontal lower truss members at a lower end forming a "pin connection" and joined together at upper ends by a buoyant deck mount structure, and/or by horizontal truss members, to form a "moment connection". A buoyant keel tank having a central moon pool can be retracted and extended relative to the main columns between a retracted transport mode and an extended operating mode. Ballast of the columns and keel tank can be adjusted to raise or lower the center of gravity of the structure with respect to its center of buoyancy to stabilize the structure and compensate for variable loads, fixed loads, deck payloads, environmental conditions, and operational and installation stages. The deck mount structure has box-like generally rectangular sides and may be in the form of a ring or may have a C-frame configuration with three box-like generally rectangular sides to define a wide opening between two laterally adjacent main columns on one side of the platform to allow on-site float-over deck installation of the platform deck from a barge onto the top of the deck mount structure.

A buoyant keel tank having a central moon pool is secured at the bottom ends of telescoping columns mounted in the main columns and can be retracted and extended relative to the main columns between a retracted transport mode and an extended operating mode. The weight and buoyancy of the main columns and keel tank is adjustably tuned to raise or lower the center of gravity of the entire mass of the structure with respect to its center of buoyancy according to ballast and variable or fixed loads including deck payloads, to stabilize the structure, and to compensate for different operational, environmental, survival and installation stages of the structure.

The present semi-submersible floating offshore platform incorporates technology that has significant differences and advantages over conventional semi-submersible structures in its structural load path, in its hydrodynamic performance, and in its ease of fabrication and transportation. Cost of fabrication is reduced with the simplicity of the hull design and eliminating large pontoon structures.

In contrast to conventional semi-submersible structures, the present semi-submersible platforms have a "moment connection" at the top of the columns and hinge or "pin connection" at the bottom of the columns provided by the submerged lateral truss structures connecting the columns on all four sides. The submerged lateral truss structures eliminate the large shell type boxed pontoons. These features significantly reduce the overall wave forces on the platform.

FIG. 12 illustrates schematically the forces on a moment connection at the top of a column and a truss pin connection at the bottom of the column, as utilized in the present invention. The "moment connection" of the deck mount structure at the top of the column forms a moment connection that transfers moment "M" as well as axial and shear forces between the connected members. The trusses at the lower end of the column form a pin connection that transfers axial and shear forces "P" between the connected members, but not moments. The force "P" acts in equal and opposite directions and is equal to the moment "M" divided by the distance "D" between the upper and lower horizontal tubular members of the truss.

The moment connection at the top of the columns and lateral truss pin connection at the bottom significantly increases structural stability of the present semi-submersible platforms. The trusses are open frame structures formed of small diameter tubular members and are transparent to wave action, thus, wave forces on the platform are reduced significantly. Because the wave forces are predominantly only on the vertical columns and much less on the trusses, the fatigue life of the platform is enhanced. This feature also reduces the mooring loads and force requirements for dynamic positioning thrusters. The lateral trusses also simplify the construction and total fabrication cost of the platform.

The moment connection at top of the columns is obtained by the box type framed deck mount structure welded to the top of the columns on three sides, leaving one side open, known as a "C-frame", or on all four sides, known as a "Ring-frame" structure. The C-frame deck mount structure is designed with a very strong transverse side or back and two lateral sides connected to the transverse side or back and reinforced by triangular corner braces or corner knee braces. The box type deck mount structure is disposed well above the water surface with sufficient clearance to meet maximum wave heights, thus the platform is less subject to wave forces. The C-shaped deck mount structure also allows on-site float-over deck installation of the platform deck from a barge onto the top of the deck mount structure or main columns.

The columns are designed to take the vertical loads of the deck and have a large cross sectional area are of sufficient length to provide the required buoyancy for the platform, and are spaced apart to provide stability and adequate water plane area.

The keel tank is designed such that the mass and the ballast lower the center of gravity (CG) in the fully extended operating condition. The keel tank is retracted such that the platform is of a compact height during fabrication and transportation. This feature also allows the platform to work at a site for a particular period of time and then easily be relocated to another site by retracting the keel tank to assume a compact height.

The telescoping keel tank with the moon pool opening assists in all the phases of operation including fabrication, installation, in-place performances, and riser and/or tendon tensioning. Utilizing the telescoping keel tank for self-installation eliminates the need of an installation vessel onsite. When the risers are tensioned with the help of the keel tank, the deck is freed from the riser load. This is very advantageous in deepwater applications.

The platform with the framed deck support structure with a moment connection at the top of the columns above water and open frame truss pin connection at the bottom of the columns submerged also make the platform suitable for using vertical tension moorings with tethers to function as a tension leg platform (TLP) for deepwater applications. The TLP embodiment may be provides with or without the keel tank. With the keel tank, the tethers are connected to the keel tank at four corners and the ballast is adjusted to provide the required tension to the tethers. Without the keel tank, the tension leg tethers are connected to lower end of the four main columns and the ballast of the columns is adjusted to provide tension to the tethers.

Elimination of the pontoons and providing the rigid deck mount structure at the top of the columns reduces the mass and overall wave forces on the platform and enables the tension leg (TLP) configuration to be used in ultra deepwater and enables control the natural period of the platform and thereby reduce heave and pitch motions of the platform significantly resulting in smaller dynamic tension in the vertical moorings, such as tendons or tethers.

The present semi-submersible floating offshore platforms provide several deck installation options: (1) The deck structure and related equipment may be preinstalled at the top of the hull at the construction site; (2) the deck structure and related equipment may be integrated to the hull at quayside; or (3) in an embodiment having a generally C-shaped deck mount the platform deck may be floated over the hull on a barge and installed on the top of the hull at the operation site.

The structural and hydrodynamic response features of the present semi-submersible floating offshore platforms allow them to respond to effectively to heave motions and environmental forces in ultra-deepwater and the platform deck is independent of vertical riser and mooring loads, making them suitable for dry tree support in either low or moderate sea states as well as in extreme sea states.

With the present floating offshore platforms, the deck could be swapped out for different applications for different needs and different phases of the operations such as: drilling, production, and riserless well intervention, etc. For example, a drilling facility deck may be installed by the float-over technique, and when drilling is completed, the drilling deck removed with the help of the barge, and then a production deck installed by the float-over method. When well servicing is needed to improve the performance of the well production, then the production deck is replaced with a riserless well-intervention deck. After the well is reinstalled back to full production, the well-intervention deck may be replaced with the production deck.

Other features and advantages of the invention will become apparent from time to time throughout the specification and claims as hereinafter related.

DESCRIPTION OF THE PREFERRED EMBODIMENTS

Figure 1:
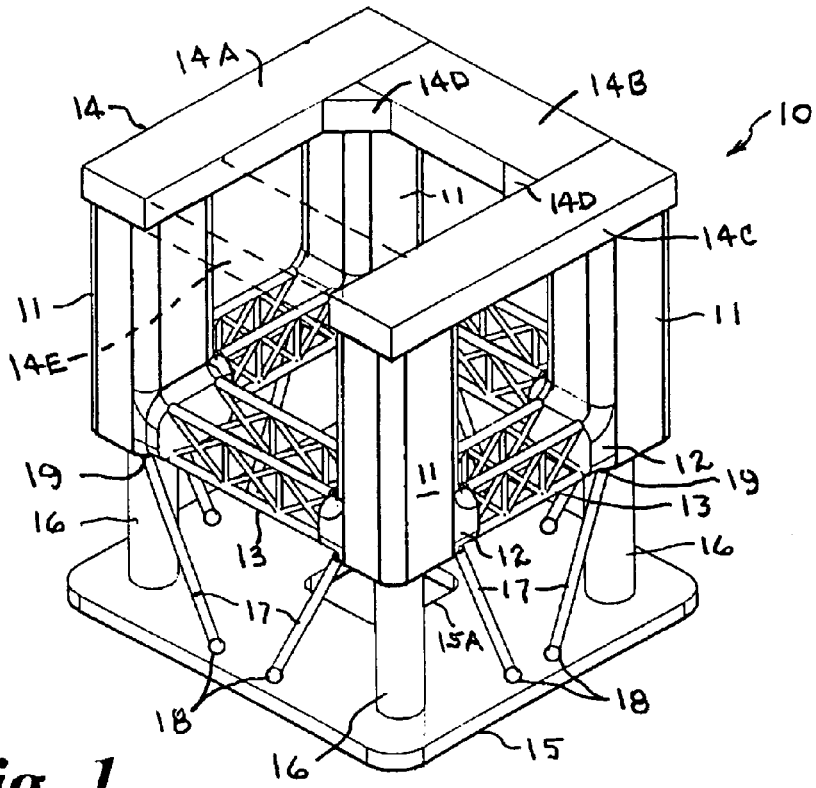
FIG. 1 is a perspective view of the semi-submersible floating offshore drilling and production platform structure in accordance with the present invention as viewed from the top shown without a deck installed on the deck mount structure.
Figure 2:
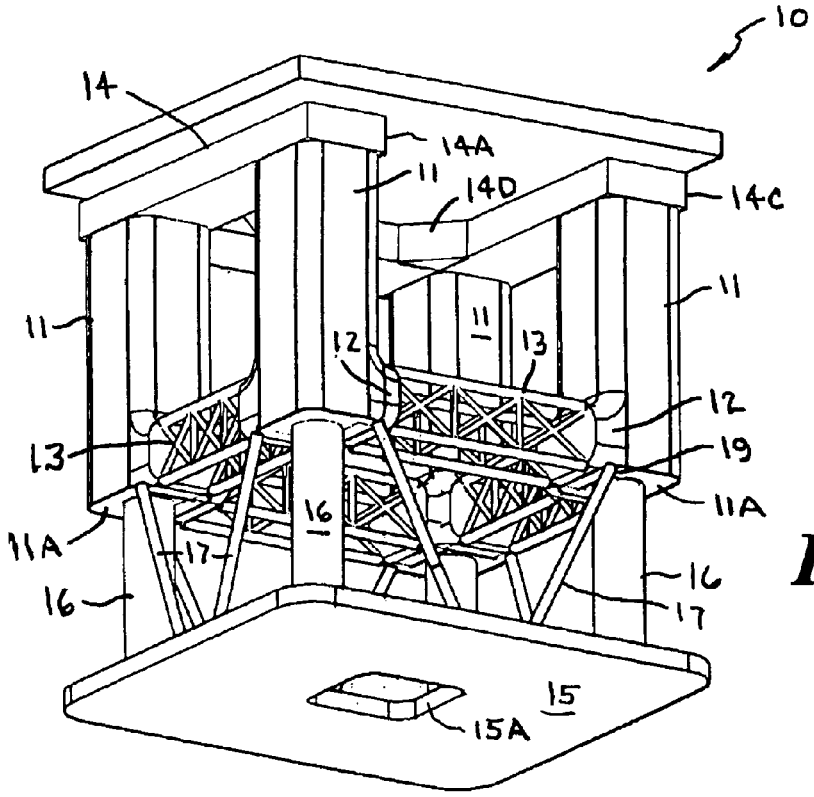
FIG. 2 is a perspective view of the semi-submersible floating offshore drilling and production platform structure as viewed from the bottom with a deck installed on the deck mount structure.

Referring now to FIGS. 1 and 2, there is shown, somewhat schematically, a column stabilized semi-submersible floating offshore drilling and production platform structure 10 in accordance with the present invention. The platform structure 10 has four main vertical columns 11, which may be of generally rectangular or circular cross section, with short horizontal lateral extensions 12 at their lower ends facing in opposed relation, and lateral truss members 13 formed of cross-braced tubular members extending horizontally between the extensions at the lower end of the main columns connecting the adjacent columns.

A generally C-shaped or U-shaped deck mount structure 14 is secured to the top ends of the main vertical columns 11 for receiving and supporting a deck D (seen in FIG. 2). The deck mount structure 14 has three box-like generally rectangular sides 14A, 14B and 14C formed of metal plate defining a hollow interior and is open on one side defining a wide opening between two laterally adjacent main vertical columns 11. The deck mount structure 14 is reinforced at two inside corners by a triangular box-like diagonal brace 14E to add additional strength and support and reduce deformation at the free ends of the lateral sides of the open area. The deck D may be installed on the deck mount structure 14 by several different alternative methods, as discussed hereinafter.

Alternatively, as shown in dashed line in FIG. 1, the deck mount structure 14 may also be provided with a fourth box-like generally rectangular side 14D to form a generally rectangular ring enclosed on all four sides, and provided with a triangular box-like diagonal brace 14D in each inside corner.

The bottom ends of the main vertical columns 11 are enclosed by end plates 11A. A generally rectangular ring-like keel tank 15 is supported beneath the bottom ends of the vertical columns 11 by smaller cylindrical vertical telescoping columns 16 each passing slidably through a bottom end plate 11A of a respective main vertical column. The cylindrical vertical telescoping columns 16 are mounted in the main vertical columns 11 to be extended and retracted relative to the main vertical columns. The generally rectangular keel tank is formed of metal plate defining a hollow interior compartment capable of being ballasted and de-ballasted and has a central moon pool opening 15A.

The cylindrical telescoping columns 16 and keel tank 15 may be raised and lowered by conventional raising and lowering mechanisms for extensible and retractable movement at various distances relative to the generally rectangular columns 11 for carrying out various operations, and may be locked at a fully extended or retracted position by a locking mechanism described hereinafter or other conventional locking mechanisms.

Conventional ballast control means, pumps and piping systems are provided for selectively pumping water into and out of the main vertical columns 11 and keel tank 15 to partially or fully flood and empty the columns and keel tank and thereby adjust the weight and ballast. Such raising and lowering mechanisms and means for flooding and de-flooding are conventional and well known in general shipboard and submarine ballast design practice, and therefore not shown or described in detail.

Figure 3:
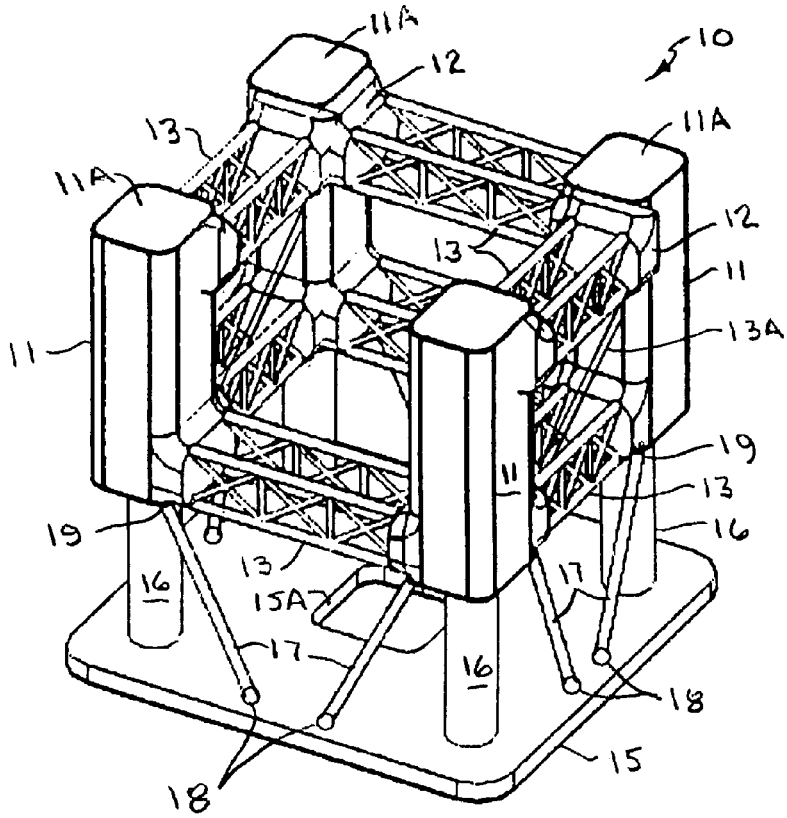
FIG. 3 is a perspective view of a modification of the semi-submersible floating offshore drilling and production platform structure without a deck mount structure as seen from the top without a deck mount structure.

FIG. 3 shows a modification of the platform 10 wherein the upper ends of the four main vertical columns 11 have short horizontal lateral extensions 12 facing in opposed relation, and lateral truss members 13 formed of cross-braced tubular members extend horizontally between the extensions at the upper end of the main vertical columns connecting the adjacent columns, and leaving one side open defining a wide opening between the upper ends of two laterally adjacent main vertical columns. Thus, the platform 10 has lateral truss members 13 extending horizontally between the lower end of the main vertical columns 11 on all four sides, and lateral truss members 13 extending horizontally between the upper end of the main vertical columns on three sides, and leaving one side open. The three-sided truss configuration is reinforced at two inside corners by a diagonal brace or knee strut to add additional strength and support and reduce deformation at the free ends of the lateral sides of the open area. A diagonal brace 13A may also be secured diagonally between the top corner of the lower lateral truss members and the lower corner of the upper lateral truss members.

This modification may be used with or without the generally C-shaped or U-shaped deck mount structure 14. If the deck mount structure 14 is not used, lateral truss members 13 may be provided between the upper end of the main vertical columns on all four sides, and a deck may be secured to the top ends of the main vertical columns in a conventional manner to provide smaller deck load and total hull weight. This would also move the center of gravity (CG) of the entire structure downward. Braces may be provided between the top of the upper trusses and the deck or columns if required for structural integrity.

Figure 4A:
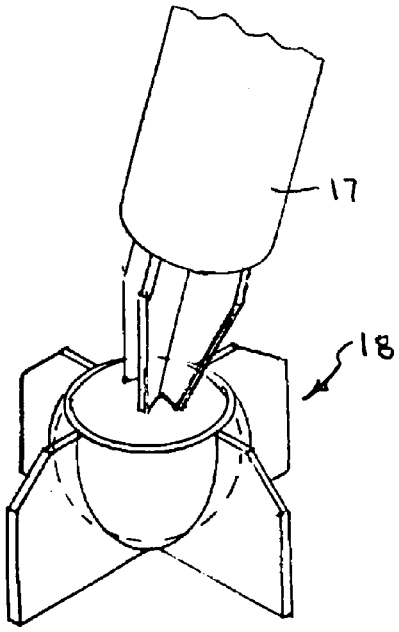
FIG. 4A is a perspective view showing somewhat schematically, an example of a bottom connector for connecting the lower ends of the knee braces to the keel tank.
Figure 4B:
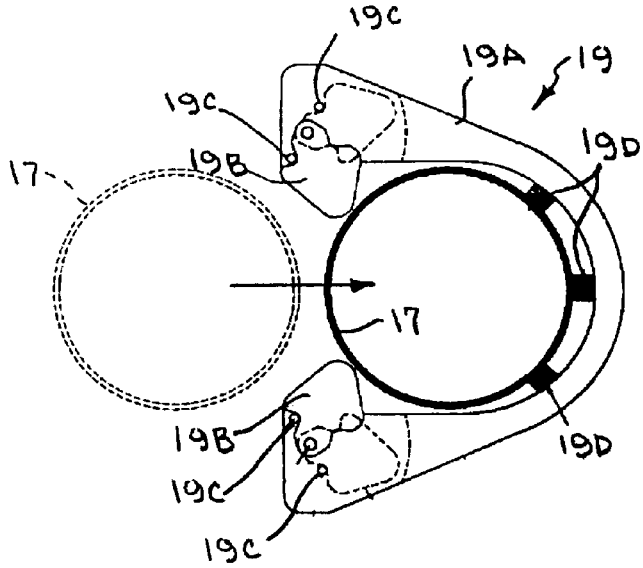
FIG. 4B is an elevation view showing somewhat schematically, a self-locking latch mechanism for connecting the upper ends of the knee braces to the columns.

Referring additionally to FIGS. 4A and 4B, a pair of knee braces 17 may be releasably connected between the keel tank 15 and the lower end of each main vertical column 111 on each of the four sides of the platform structure by a crane structure on the deck. The knee braces 17 are rotatably connected at a bottom end to the top surface of the keel tank 15 by a ball joint connection 18, and are releasably connected at a top end to the lower end of each main vertical column 11 by a receiving and self locking latch mechanism 19. The knee braces 17 may be provided with universal joints at both ends. However, the joint at the bottom end is not removable whereas the joint at the top of the knee brace connecting it to the column is removable when needed. When the keel tank 15 is in a retracted position, the knee braces 17 are stowed in a horizontal position on the top of the keel tank with one end connected by the ball joint connection 18, and, when the keel tank is extended, their opposed end is received in the self locking latch mechanism 19 and connected to the lower end of the main vertical column 11 such that each pair of braces extend angularly between the keel tank and the adjacent columns.

FIG. 4B shows, somewhat schematically, an example of a self locking latch mechanism 19. The latch mechanism 19 has a U-shaped frame 19A with a spring biased latch member 19B hingedly mounted in the outer end of each leg of the frame. The latch members 19B are biased normally outwardly in laterally opposed relation. As shown in dashed line, when the upper end of the knee brace 17 enters the U-shaped frame 19A, the latch members 19B are pressed inwardly against the spring pressure, and as the upper end of the brace passes by them, they spring back out to capture the upper end of the knee brace. A pair of stop pins 19C limit the inward and outward travel of each latch member 19B. The inner surface of the U-shaped frame 19A may be provided with resilient pads 19D for engaging the upper end of the knee brace 17. The upper end of the knee brace 17 may be removed from the latch mechanism 19 by removing the outward travel limit pin 19C by mechanical means or retracting it hydraulically.

In a preferred embodiment, the knee braces 17 are designed to be neutrally buoyant for ease of crane handling and installation. The knee braces 17 take the axial load without transferring a moment arm load to the columns. Thus, the fatigue life of the knee braces at their connections is enhanced. Eight knee braces, two per side, are used such that over all structural stability of the vessel is achieved. The locking connections at the top of the knee braces are designed to be unlocked such that the braces can be disconnected from the columns and stowed back horizontally on top of the keel tank to allow the keel tank to be de-ballasted and retracted to a compact floating or transportation draft.

Figure 5A:
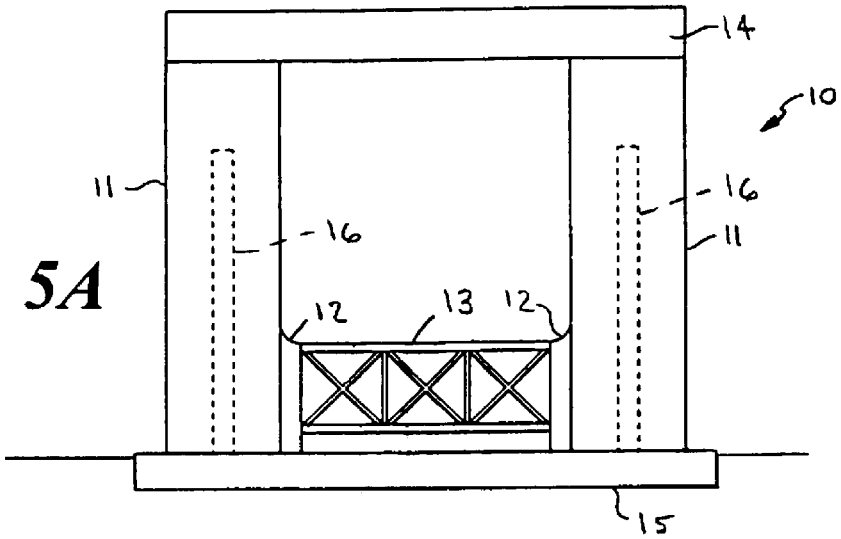
FIGS. 5A and 5B are side elevation views showing, somewhat schematically, the semi-submersible floating offshore drilling and production platform in a transport mode, and in an operating mode, respectively.
Figure 5B:
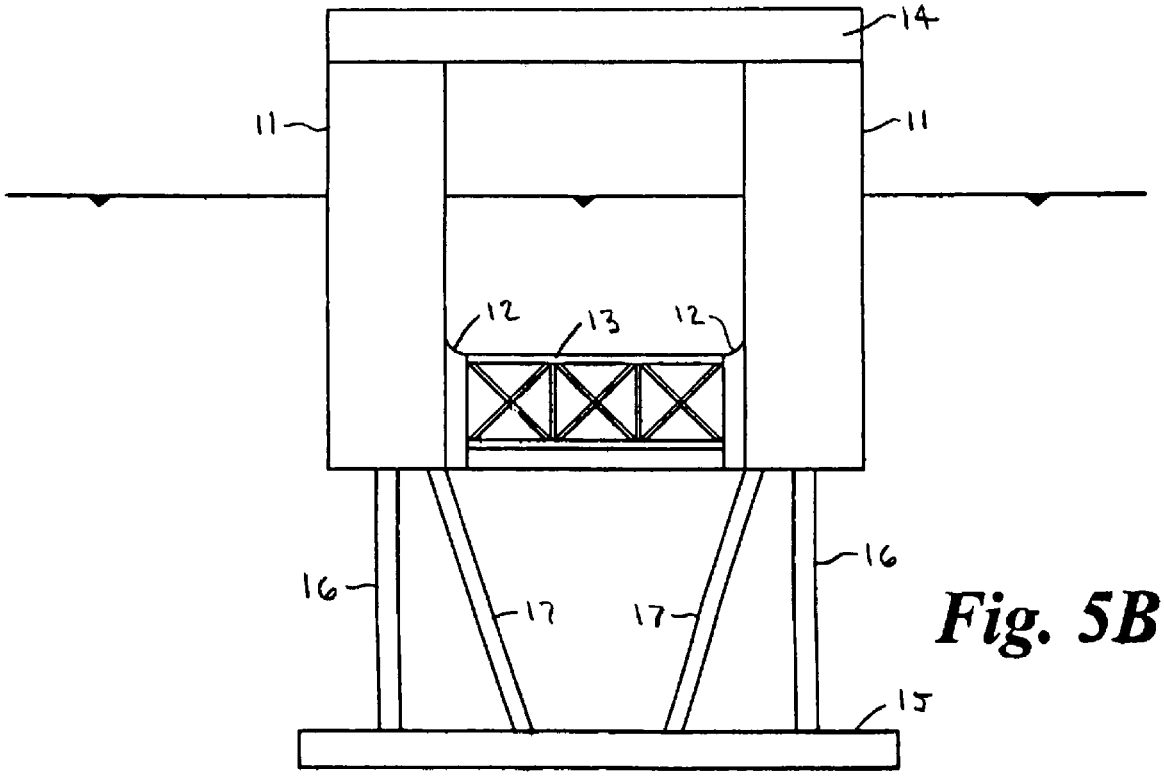

FIGS. 5A and 5B are side elevation views showing somewhat schematically, the semi-submersible floating offshore drilling and production platform structure 10 in accordance with the present invention in a transport mode and in an operating mode, respectively. In FIG. 5A, the knee braces are not shown and the keel tank 16 is shown fully retracted in the transportation mode. In FIG. 5B, the keel tank 15 is fully extended with the knee braces 17 extending angularly between the keel tank and the adjacent columns 11.

As mentioned above, the cylindrical columns 16 and keel tank 15 may be raised and lowered by conventional raising and lowering mechanisms for extensible and retractable movement at various distances relative to the generally rectangular columns 11 for carrying out various operations, and may be locked at a fully extended or retracted position by a locking mechanism. When the keel tank 15 is telescoped down, it could be locked in-place to resist the heave added mass forces during operation if desired.

In some installations, depending upon the severity of the platform motion and the loads, the knee-braces may be eliminated, and several mechanisms may be used to lock the telescoping cylindrical column 16 to the generally rectangular columns 11. For example, a hydraulically operated locking system may be placed inside the main vertical columns 11 and locked to withstand vertical loads due to wave and inertial loads on the keel-tank. The locking mechanism of such a locking system would be operated by hydraulic pressure and controlled from the top of the deck.

Figure 6A:
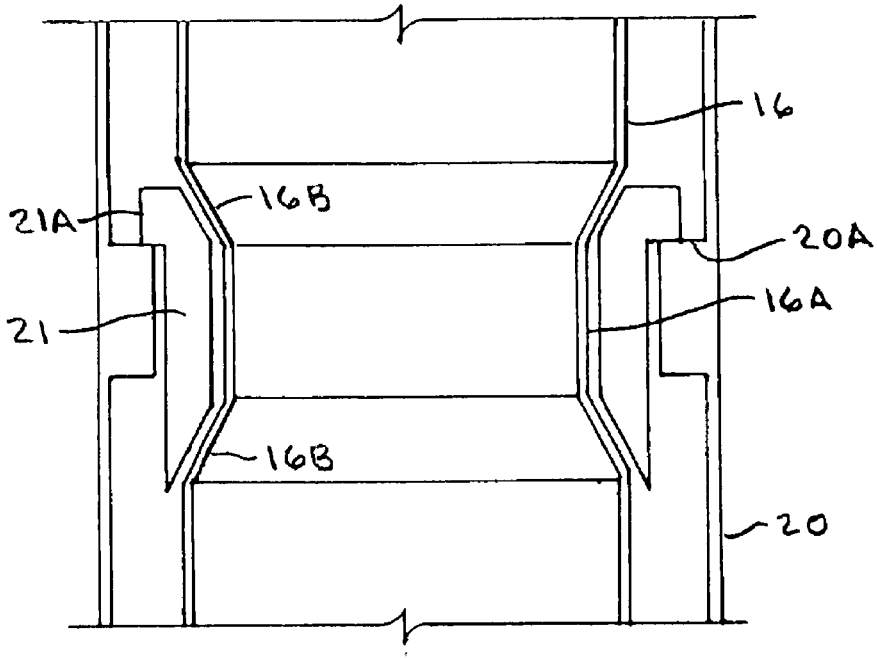
FIGS. 6A and 6B are longitudinal cross sections showing, somewhat schematically, an example of a hydraulic locking mechanism at the upper and lower end portions, respectively, of the telescoping cylindrical column located inside the main columns.
Figure 6B:
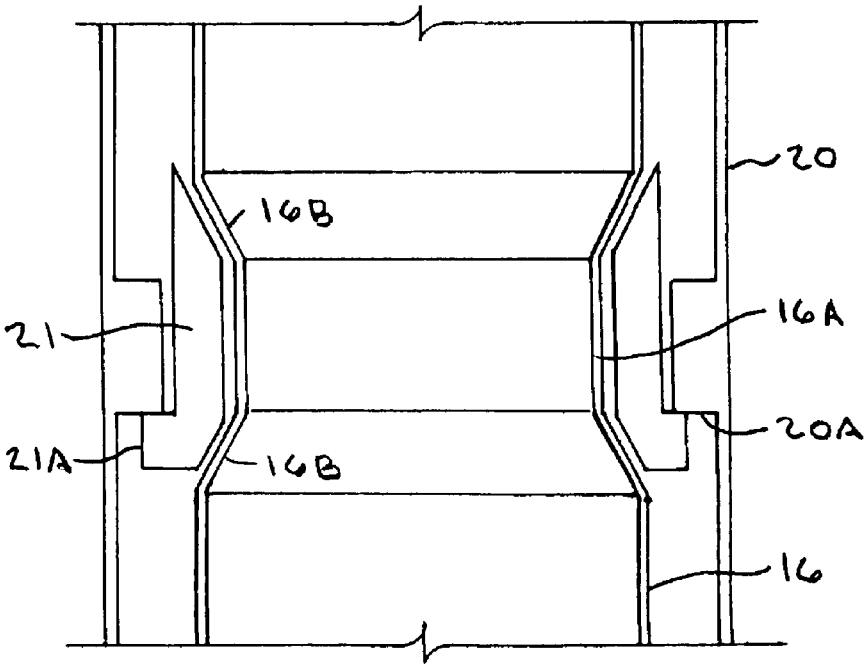

FIGS. 6A and 6B illustrate somewhat schematically, an example, of a hydraulic locking system. In this example, an upper end portion (FIG. 6A) and a lower end portion (FIG. 6B) of the outside diameter of the telescoping cylindrical column 16 is provided with a reduced diameter portion 16A with opposed circumferential tapered portions 16B above and below the reduced diameter. An outer ring 20 having an interior radial shoulder 20A is secured to the interior of the main vertical column 11 at its upper end and lower end. An expandable split ring 21 having a radial flange 21A at one end and a tapered interior surface 21B at opposed ends is disposed between the exterior of the telescoping column 16 and the interior of the outer ring 20. It should be noted that the radial flange 20A in the outer ring 20 at the upper end (FIG. 6A) and the radial flange 20A in the outer ring 20 at the lower end (FIG. 6B) are disposed in vertically opposed relation.

During downward travel of the telescoping column 16, when it reaches its lowermost extent, the split ring 21 is expanded radially inward such that the upper tapered surface 16B at the upper end of the telescoping column 16 engages the interior tapered surface 20B at the top of the split ring and its radial flange 21A engages the radial shoulder 20A of the outer ring 20 to prevent further downward movement (FIG. 6A) and the column 16 takes the tension load. Similarly, during upward travel of the telescoping column 16, when it reaches its uppermost extent, the split ring 21 is expanded radially inward such that the lower tapered surface 16B at the lower end of the telescoping column engages the interior tapered surface 21B at the bottom of the split ring 21 and its radial flange 21A engages the radial shoulder 20A of the outer ring 20 to prevent further upward movement (FIG. 6B) and the column 16 takes the compression load.

Thus, the telescoping column 16 may be operated to provide a reduced length for compression load and longer length for the tension/pulling load when the waves act on the keel tank 15, thereby enhancing the structural load carrying efficiency of the telescopic inner column. Once these two locks at the upper and lower ends of the column 16 are engaged by the hydraulic system, then the keel tank 15 is fixed at the desired telescoped location. As discussed above, the knee braces 17 also share the axial loads, and the locking system may be provided as an alternative to the knee braces if they are eliminated, or provided in addition to the knee braces to share loads between the keel tank and the upper hull.

Figure 7A:
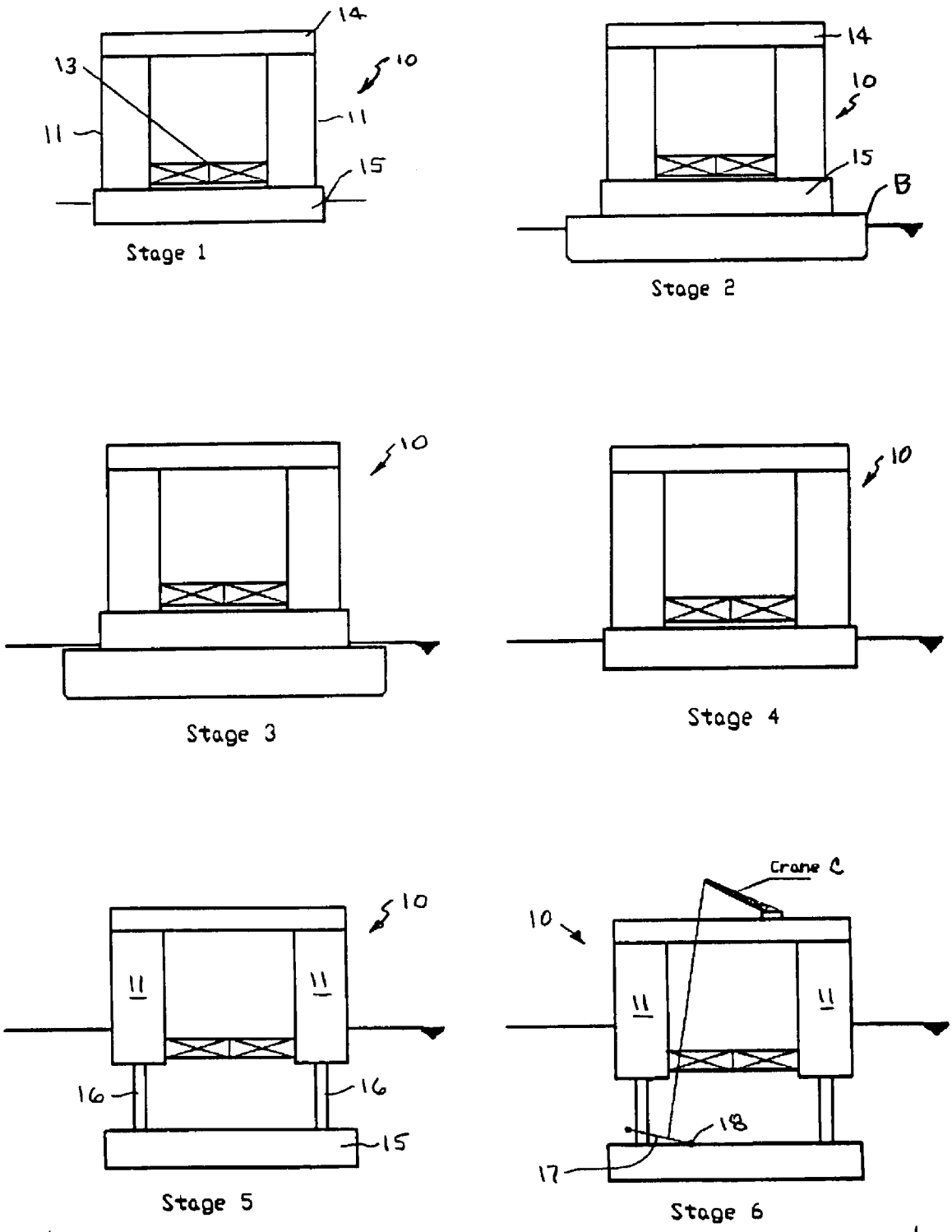
FIGS. 7A and 7B are schematic side elevation views illustrating the steps in fabricating, transporting, and self-installing of the semi-submersible floating offshore drilling and production platform to a site of operation.
Figure 7B:
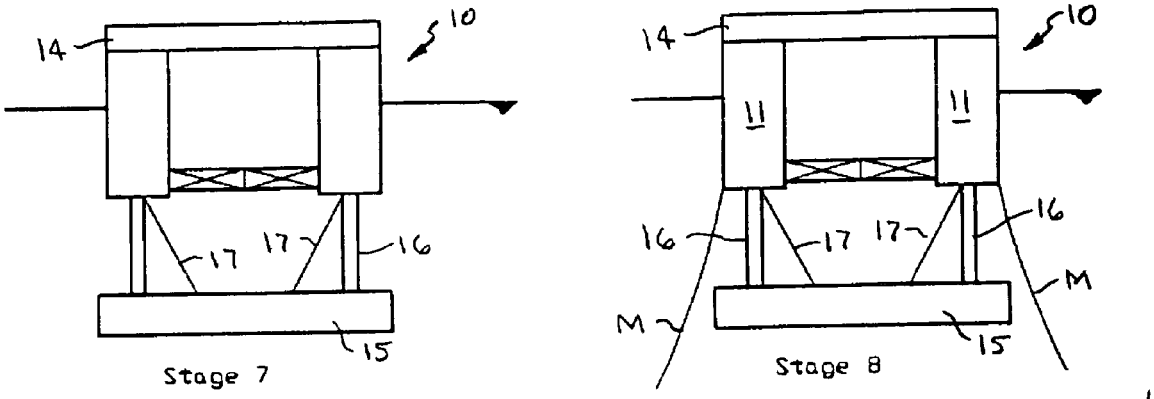

FIGS. 7A and 7B are schematic side elevation views illustrating the steps in fabricating, and transporting the semi-submersible floating offshore drilling and production platform 10 to a site of operation. The platform is fabricated in the shipyard and skidded into the water to float on the retracted keel tank. It is then lifted on to the deck of a transportation barge B for dry transport to the operation site. When the barge reaches the operation site, the barge is flooded so that the semi submersible platform is floating on its retracted keel tank. The platform is allowed to free float in the sea and the barge is moved away from it. At this stage, the keel tank 15 is flooded to fully extend the telescoping cylindrical columns 16 and place the keel tank at the maximum distance beneath the upper main columns 11. A crane C on the deck is used to mechanically lift the upper end of the knee braces 17 and the upper ends are connected to the rectangular columns to extend between the rectangular columns and the keel tank. The platform is allowed to float with maximum telescoped keel tank extension. Mooring lines M anchored to the sea floor are attached to the four main columns of the platform. Production risers are pulled up and hung from the sides of the keel tank. The keel tank is de-ballasted to adjust the production riser tension loads and obtain the required freeboard of the columns. Conventional riser tensioners may be supported on the keel tank and used for tensioning the risers if needed. Conventional thrusters may be installed on the keel tank for dynamically positioning the platform, or for assisted dynamic positioning. Adequate gas storage is possible for the dynamic positioning system in the keel tank.

Figure 8A:
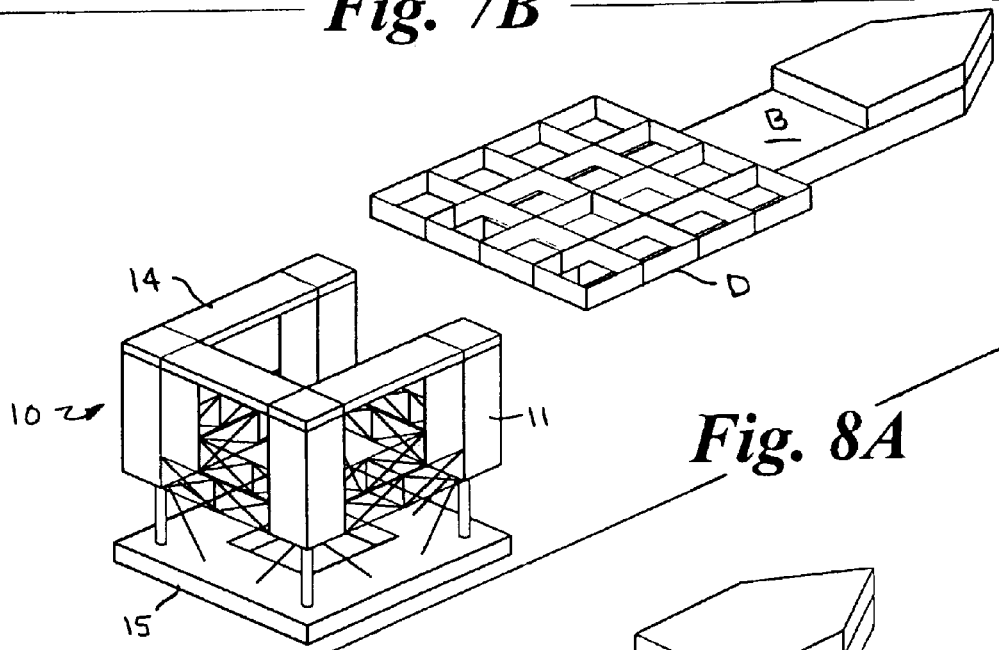
FIGS. 8A through 8D are schematic perspective views illustrating the steps in installing a deck on the top of the semi-submersible floating offshore drilling and production platform in a float-over deck installation technique.
Figure 8B:
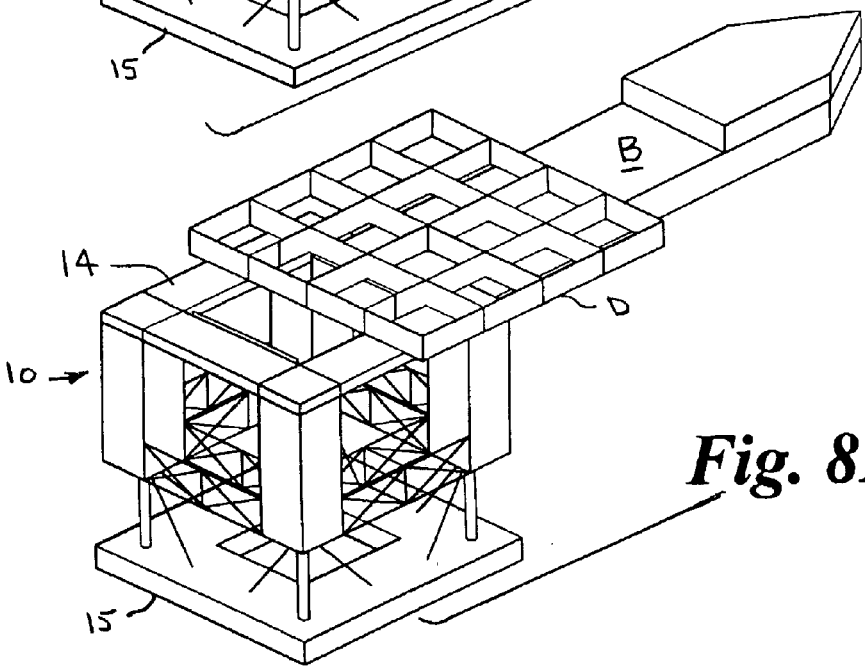
Figure 8C:
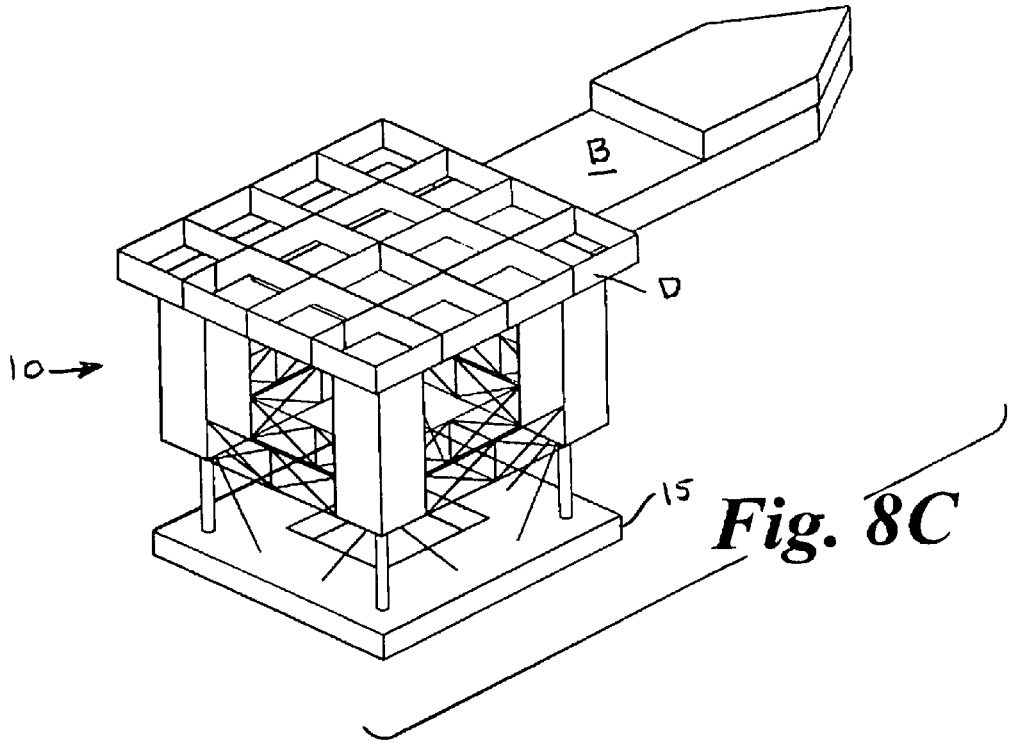
Figure 8D:
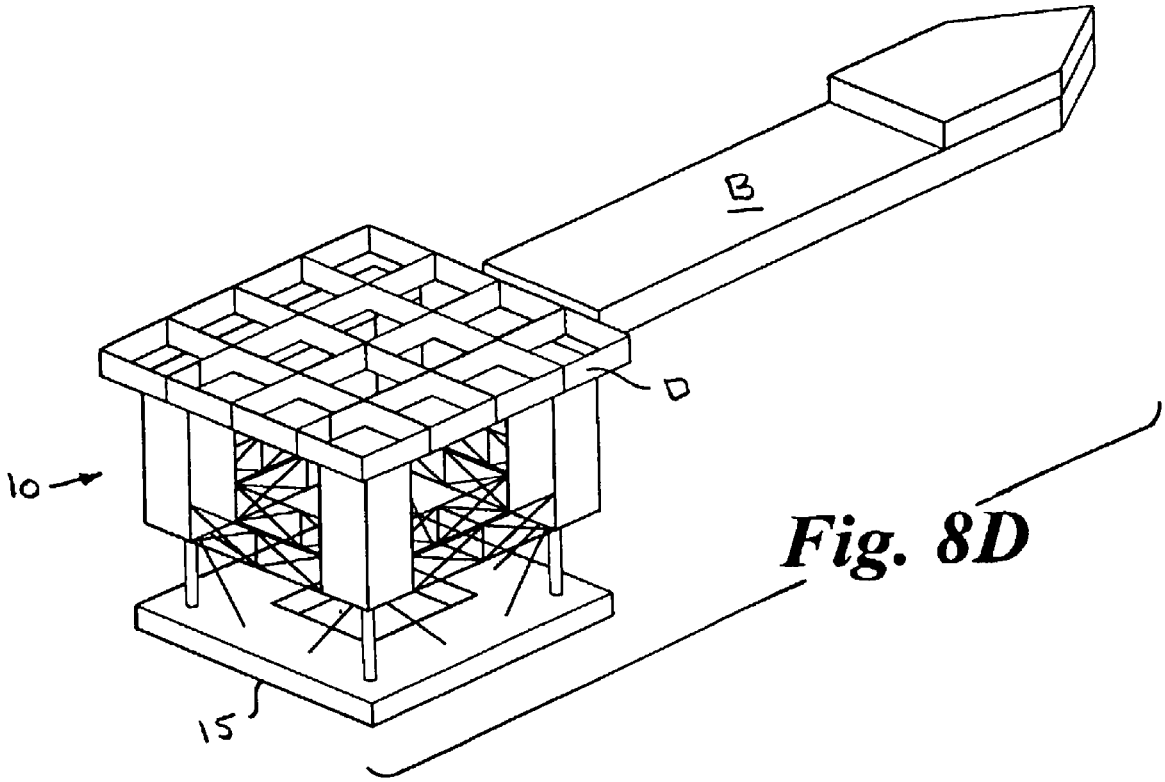

FIGS. 8A through 8D are schematic perspective views illustrating the steps in installing a deck on the top of the semi-submersible floating offshore drilling and production platform. The deck D is transported by a barge B to the site of the platform (FIG. 8A). The barge approaches from the open side of the C-shaped or U-shaped deck mount structure 14. The open side is sufficiently wide to provide clearance between the inside walls of the deck mount structure and columns for the barge to move into the open area of the platform with the deck D disposed above the deck mount structure 14 (FIG. 8B). The barge is positioned such that the deck D is disposed just over the deck mount structure, and the deck mating is accomplished with conventional equipment on the barge and also ballasting/de-ballasting both the barge and the keel tank of the platform (FIG. 8C). After the deck has been mated and secured to the deck mount structure, the barge is moved out from the open side of the platform (FIG. 8D).

Figure 9B:
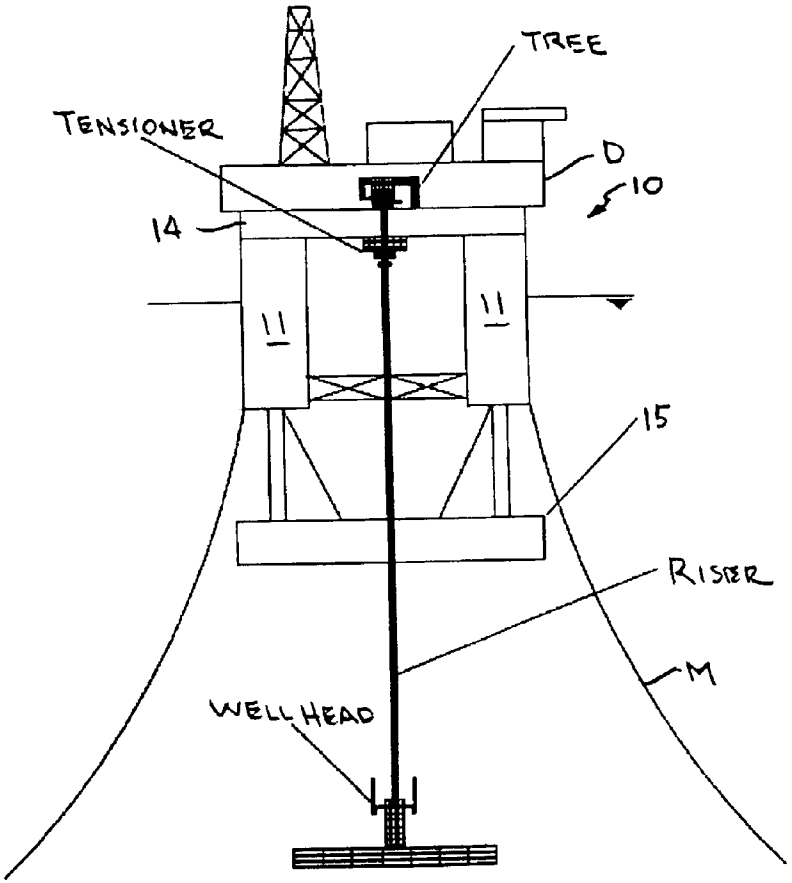
FIGS. 9A and 9B are schematic side elevation views showing the deck installed and the platform positioned above a well head on the sea floor with a dry tree placed on the platform deck and a pneumatic tensioner supported on the keel tank, and alternatively a riser extending between the well head and dry tree with the riser tensioned by a pneumatic tensioner disposed at the bottom of the deck, respectively.
Figure 9A:
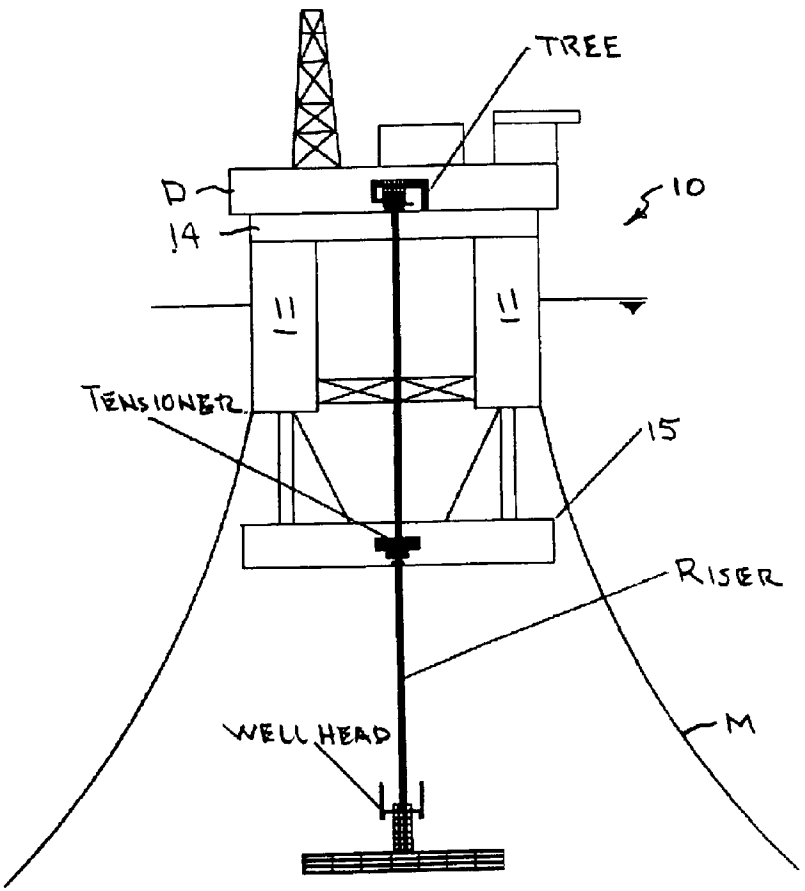

FIG. 9A is a schematic side elevation view showing the deck installed and the platform positioned by mooring lines M above a well head on the sea floor with a dry tree on the platform deck and a pneumatic riser tensioner supported on the keel tank. Riser tensioners may be may be supported on the outer sides of the keel tank or on the inner sides of the central moon pool FIG. 9B shows and alternate arrangement wherein a riser extends between the well head and dry tree with the riser tensioned by a pneumatic tensioner disposed on the deck.

The knee braces 17 take the vertical loads, thus, oil storage is feasible in the keel tank and the platform may be utilized in ultra deepwater dry-tree support for oil and gas production and also serve as a floating production storage and off-loading (FPSO) vessel.

Figure 10:
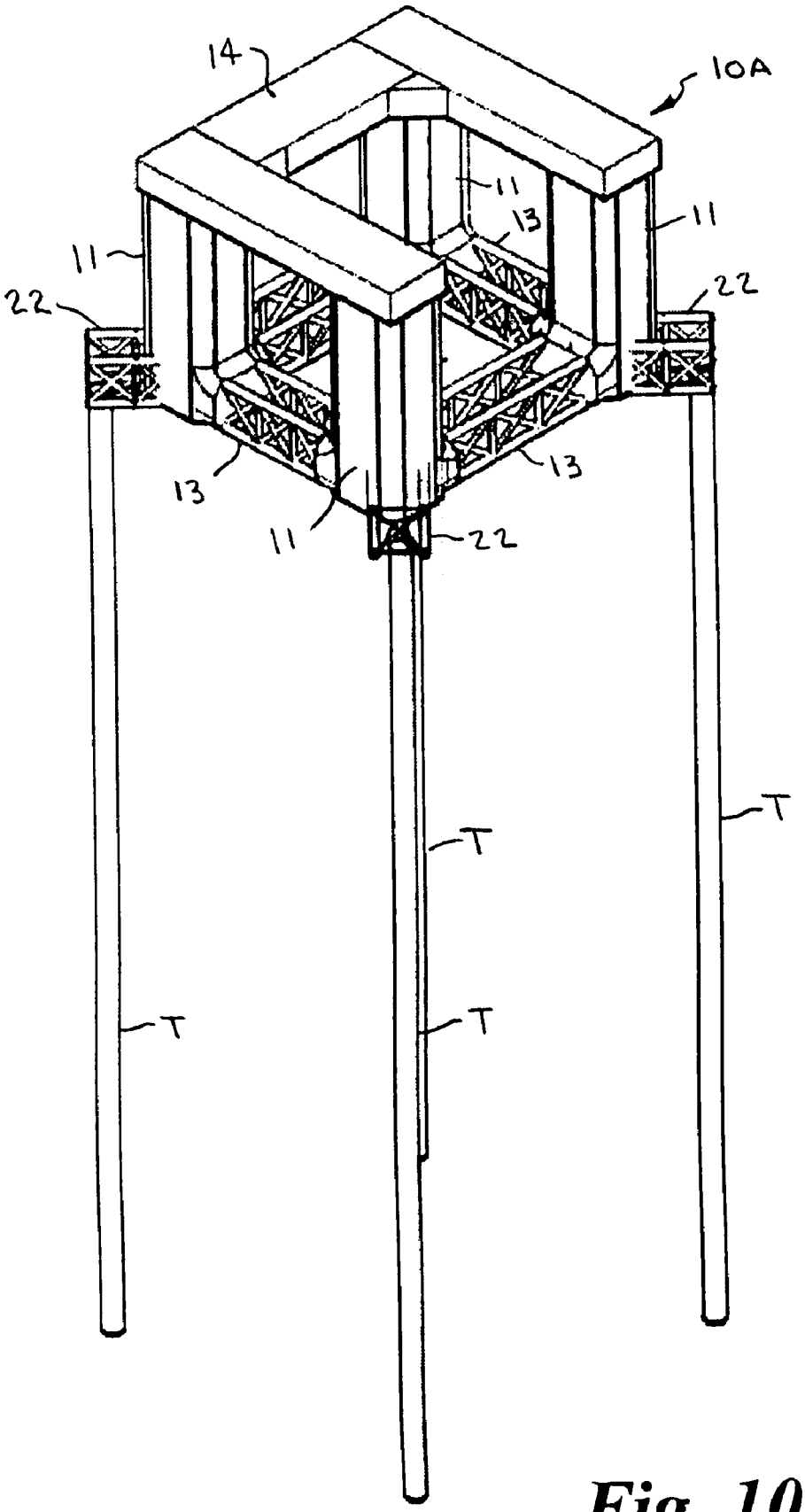
FIG. 10 is a schematic perspective view showing an alternate tension leg embodiment of the platform.

FIG. 10 is a schematic perspective view showing an alternate tension leg (TLP) embodiment of the platform 10A. The components shown and described previously are assigned the same numerals of reference, but will not be described again to avoid repetition. In this embodiment, the telescoping keel tank and vertical telescoping columns are eliminated, the bottom ends of main vertical columns 11 are sealed closed by a bottom end plate, and the generally rectangular columns 11 are ballasted and de-ballasted. Conventional pumps, control means, and piping systems are provided for selectively pumping water into and out of the columns 11 to partially or fully flood the columns and thereby adjust the weight and ballast. Such means for flooding and de-flooding a support column are conventional and well known in general shipboard and submarine ballast design practice, and therefore not shown or described in detail. In this embodiment, a cross-braced open tendon support frame 22, similar in construction to the lateral truss members, are secured to the lower end of the main vertical columns 11 and extend a short distance radially outward therefrom. Each tendon support frame 22 is provided with a conventional tendon top connector for securing the top end of at least one tendon T extending from an anchor on the seabed. Such tendon top connectors are conventional and well known in the art, and therefore not shown or described in detail.

Figure 11A:
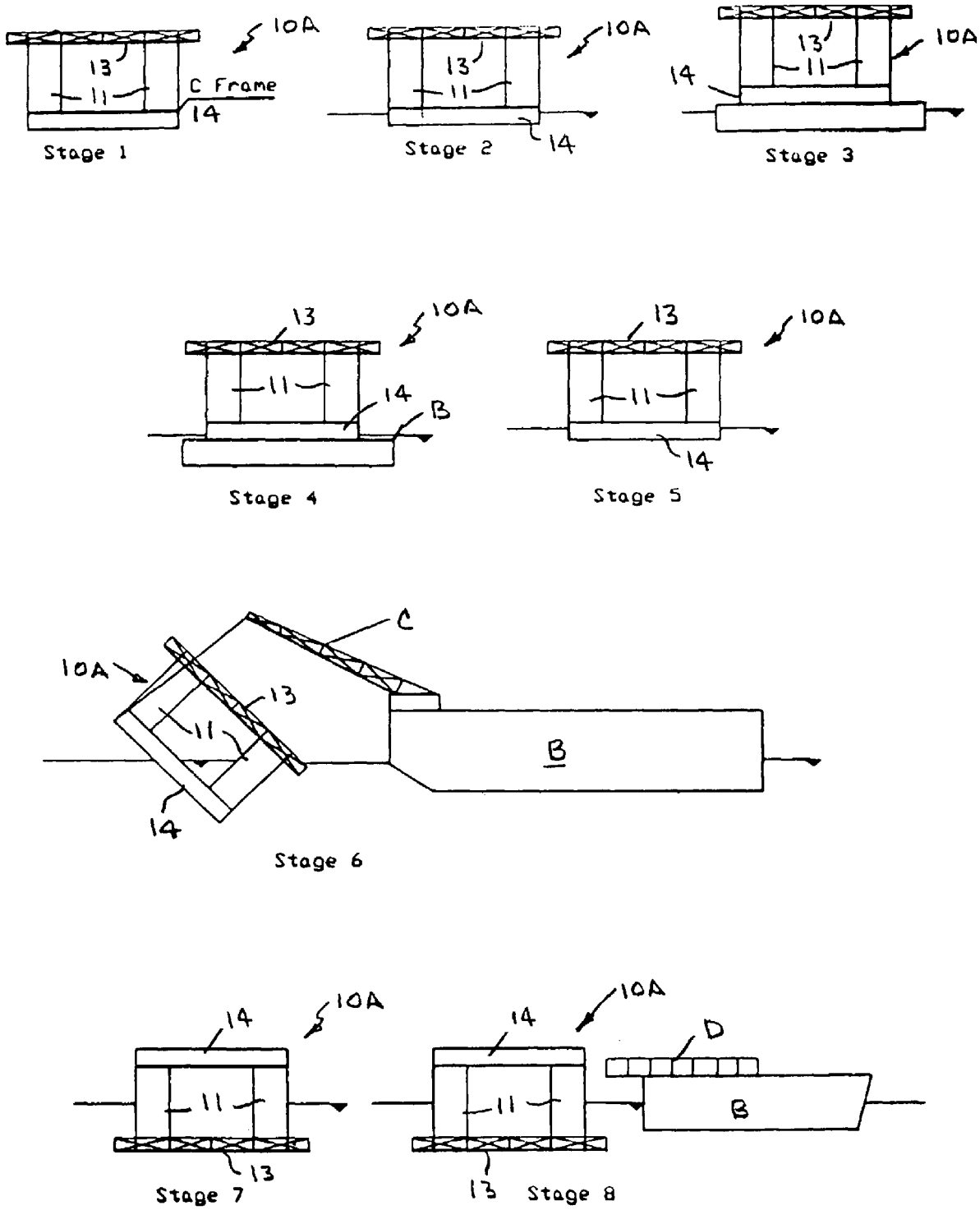
FIGS. 11A and 11B are schematic side elevation views illustrating the steps in fabricating, and transporting the tension leg platform to a site of operation, installing the deck, and tensioning the tendons.
Figure 11B:
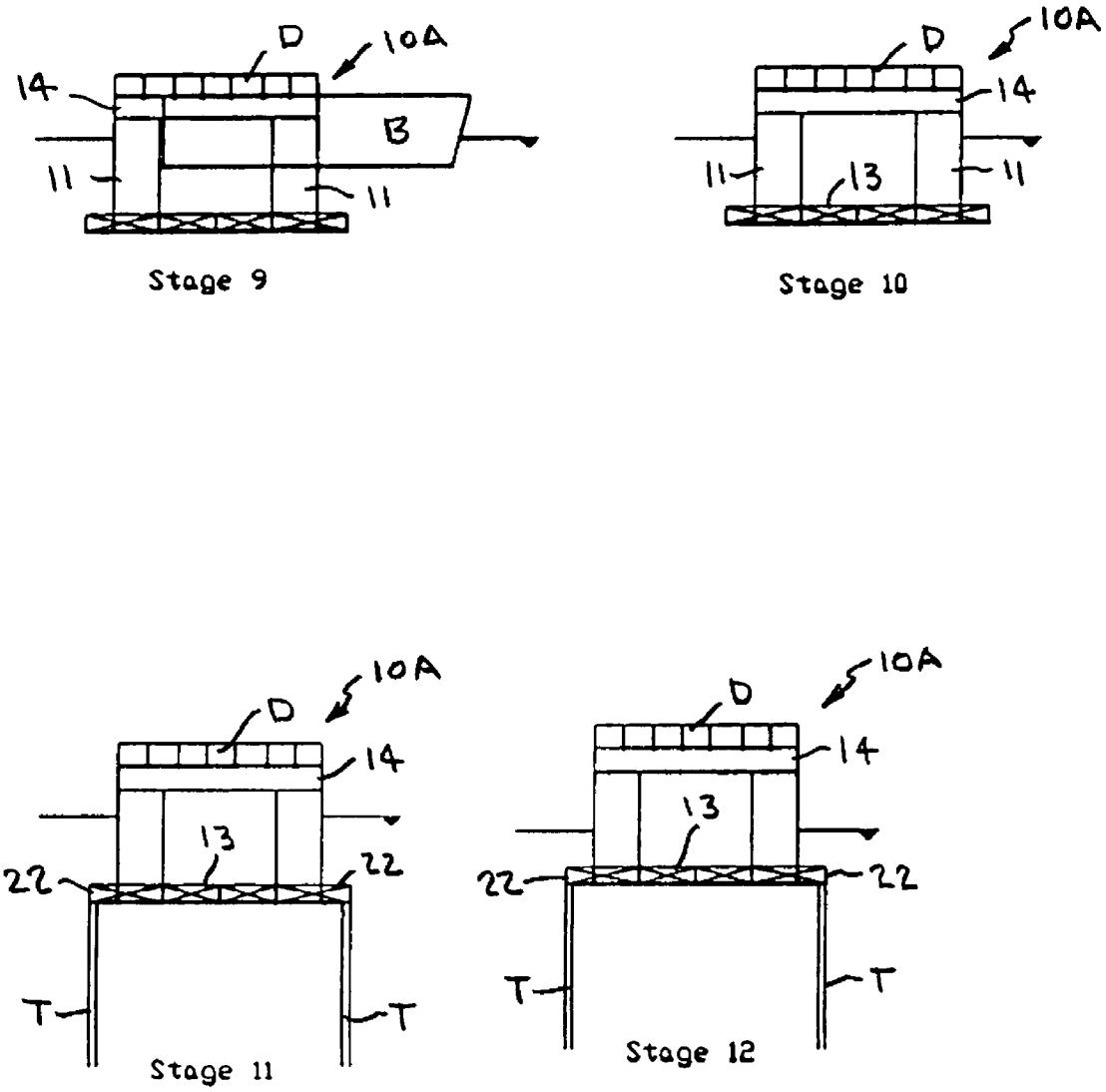
Figure 12:
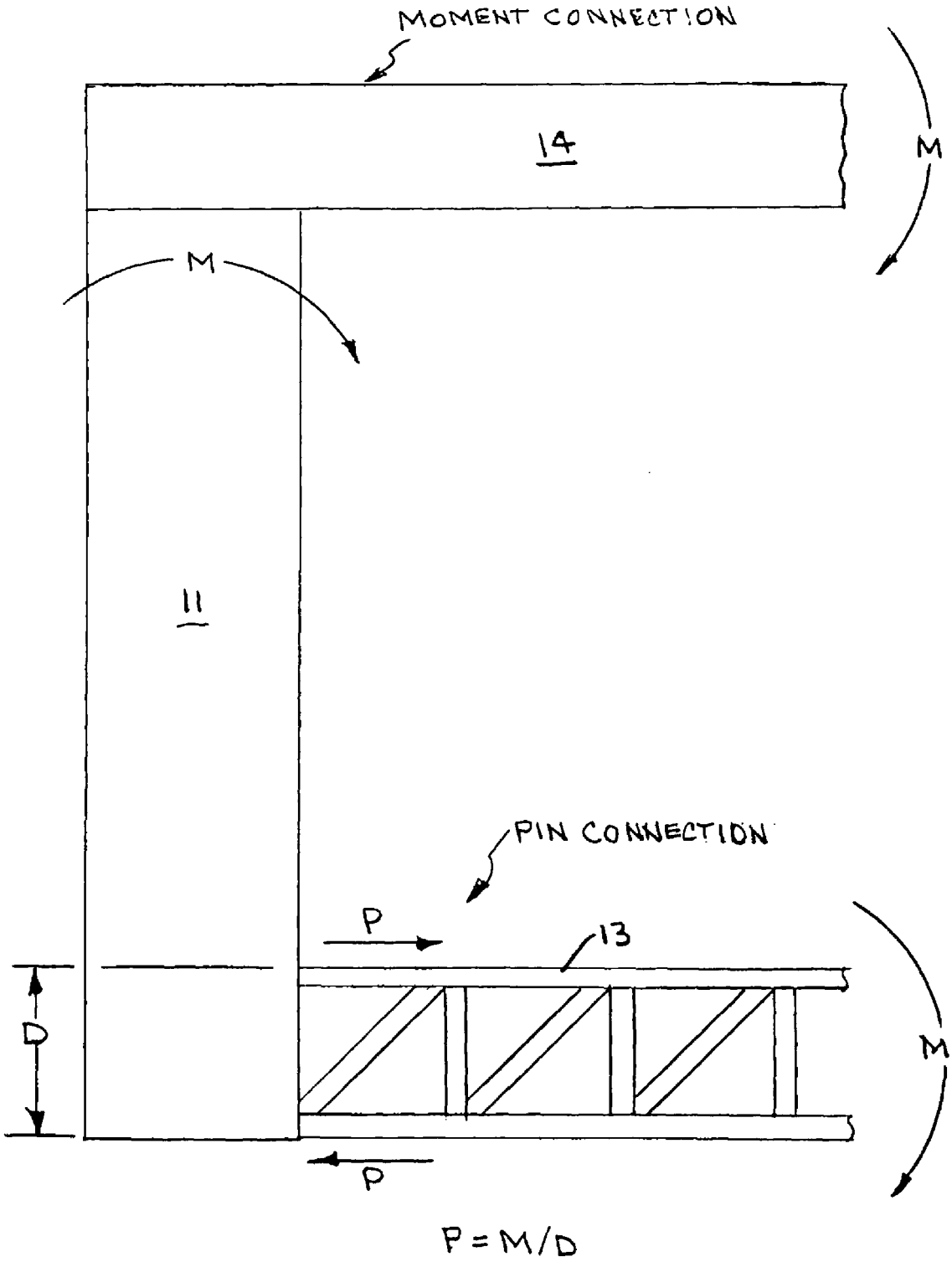
FIG. 12 is a schematic illustration showing a moment connection at the top of a column and a truss pin connection at the bottom of the column.

FIGS. 11A and 11B are schematic side elevation views illustrating the steps in fabricating, and transporting the tension leg platform embodiment 10A to a site of operation. In this embodiment the platform 10A is fabricated in the shipyard and skidded into the water to float in an inverted position on the box-like deck mount structure 14. It is then lifted on to the deck of a transportation barge B for dry transport to the operation site. When the barge reaches the operation site, the barge is flooded so that the platform is floating on its deck mount structure 14. The platform 10A is allowed to free float in the sea and the barge is moved away from it. A crane C on the deck of the barge is used to invert the platform and may be facilitated by partially flooding the columns 11 on one side while lifting the opposed side such that the deck mount structure is at the top and the columns are partially submerged. The columns are ballasted to place the deck mount structure a distance above the water surface for installation of the deck.

The deck D is transported by a barge to the site of the platform. The barge approaches from the open side of the C-shaped or U-shaped deck mount structure 14. The open side is sufficiently wide to provide clearance between the inside walls of the deck mount structure and columns for the barge to move into the open area of the platform with the deck disposed above the deck mount structure. The barge B is positioned such that the deck D is disposed just over the deck mount structure 14, and the deck mating is accomplished with conventional equipment on the barge and also ballasting/de-ballasting of both the barge and the columns of the platform. After the deck has been mated and secured to the deck mount structure, the barge is moved out from the open side of the platform. At this stage, the columns are ballasted to achieve a proper draft for connecting the top ends of the tendons T to the top connector in the tendon support frames. The columns are then de-ballasted to adjust and apply tension load on the tendons and obtain the required freeboard of the columns.

With the present floating offshore platforms, the deck could be swapped out for different applications for different needs and different phases of the operations such as: drilling, production, and riserless well intervention, etc. For example, a drilling facility deck may be installed by the float-over technique, and when drilling is completed, the drilling deck removed with the help of the barge, and then a production deck installed by the float-over method. When well servicing is needed to improve the performance of the well production, then the production deck is replaced with a riserless well-intervention deck. After the well is reinstalled back to full production, the well-intervention deck may be replaced with the production deck.

Figure 13:
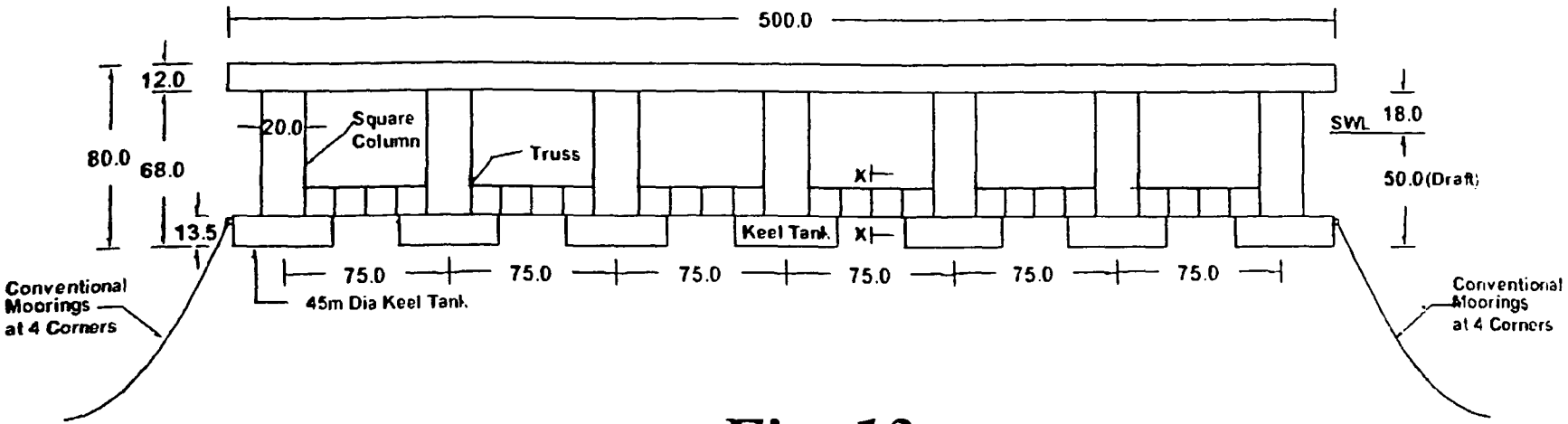
FIG. 13 is a schematic side elevation of a plurality of the floating platform structures secured together with a deck secured at the top end to form a very large column-stabilized floating offshore structure capable of use as a floating airport, port, bridge or mobile offshore base.

The present offshore floating platform structures may also be utilized for other offshore floating structure applications. For example, FIG. 13 shows schematically a plurality of the platform structures connected together by horizontal truss members and a large deck or joined decks connected together to form a very large column-stabilized floating offshore structure capable of use as a floating airport, port, bridge or mobile offshore base.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein. Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. (Currently amended A mobile column-stabilized floating offshore platform structure, comprising:

at least four spaced apart buoyant main vertical columns enclosed at top and bottom ends capable of being ballasted and de-ballasted defining four opposed sides of the platform structure;

lower lateral truss members formed of cross-braced tubular members secured horizontally between lower ends of adjacent said main vertical columns and interconnecting lower ends of said main vertical columns together in spaced apart relation on four sides of said platform structure to provide a pin connection that transfers axial and shear forces between said main columns;

a buoyant deck mount structure secured to an upper end of said spaced apart main vertical columns for receiving and supporting a deck, said deck mount structure having generally rectangular sides formed of metal plate defining a hollow interior, said deck mount structure providing a moment connection that transfers moment as well as axial and shear forces between said main columns;

cylindrical vertical columns each telescopically mounted in a respective said main vertical column and passing slidably through a bottom end of the respective said vertical column;

a buoyant generally rectangular ring keel tank secured to a bottom end of said cylindrical vertical columns formed of metal plate defining a hollow interior compartment capable of being ballasted and de-ballasted and having a central moon pool opening; wherein said keel tank is selectively retractable and extensible relative to said main vertical columns between a retracted transport mode and an extended operating mode, and is capable of tensioning riser and vertical moorings, self floatation, and optional oil storage; and the weight and buoyancy of said main columns and said keel tank is adjustable to raise or lower the center of gravity (C.G.) of the entire mass of the structure with respect to its center of buoyancy (C.B.) according to ballast and variable or fixed loads including deck payloads, to stabilize the structure, and to compensate for different operational, environmental, survival and installation stages of the structure.

2. The column-stabilized offshore floating platform structure according to claim 1, wherein said deck mount structure is a generally C-shaped or U-shaped structure having three said generally rectangular sides defining an opening between two laterally adjacent said main vertical columns of sufficient width to accommodate at least a portion of a barge.

3. The column-stabilized offshore floating platform structure according to claim 1, further comprising:

a work deck secured to said deck support structure.

4. The column-stabilized offshore floating platform structure according to claim 1, wherein said main vertical columns have a generally rectangular cross section.

5. The column-stabilized offshore floating platform structure according to claim 1, wherein said main vertical columns have a generally rectangular cross section with horizontal lateral extensions at their lower ends facing in opposed relation, and said lower lateral truss members are secured horizontally between said extensions at the lower end of said main vertical columns.

6. The column-stabilized offshore floating platform structure according to claim 1, further comprising:

lock means engageable with said smaller cylindrical vertical columns for locking said smaller cylindrical vertical columns and said keel tank at a fully extended or fully retracted position relative to said main vertical columns.

7. The column-stabilized offshore floating platform structure according to claim 1, further comprising:

a pair of brace members releasably connected between said keel tank and the lower end of a respective said main vertical column to extend angularly between said keel tank and adjacent columns on each of said four sides of said platform structure.

8. The column-stabilized offshore floating platform structure according to claim 7, wherein each of said brace members is rotatably connected with said keel tank at one end and releasably connected at an opposed end with the lower end of said respective main vertical column, whereby said brace members are stowed in a horizontal position on top of said keel tank with one end connected with said keel tank when said keel tank is in a retracted position, and when said keel tank is extended, said opposed end is connected with the lower end of said respective main vertical column.

9. The column-stabilized floating offshore structure according to claim 1, further comprising:

a plurality of said structures as defined in claim 1; and at least one deck platform secured to an upper end of said deck mount structure to form a large column-stabilized floating offshore structure capable of use as a floating airport, port, bridge or mobile offshore base.

10. A mobile column-stabilized floating offshore platform structure, comprising:

at least four spaced apart buoyant main vertical columns enclosed at top and bottom ends capable of being ballasted and de-ballasted defining four opposed sides of the platform structure;

lower lateral truss members formed of cross-braced tubular members secured horizontally between lower ends of adjacent said main vertical columns and interconnecting lower ends of said main vertical columns together in spaced apart relation on four sides of said platform structure to provide a pin connection that transfers axial and shear forces between said main columns;

upper lateral truss members formed of cross-braced tubular members secured horizontally between upper ends of adjacent said main vertical columns and interconnecting the ends of said main vertical columns together in spaced apart relation to provide a moment connection that transfers moment as well as axial and shear forces between said main columns;

cylindrical vertical columns each telescopically mounted in a respective said main vertical column and passing slidably through a bottom end of the respective said vertical column;

a buoyant generally rectangular ring keel tank secured to a bottom end of said cylindrical vertical columns, said keel tank formed of metal plate defining a hollow interior compartment capable of being ballasted and de-ballasted and having a central moon pool opening; wherein said keel tank is selectively retractable and extensible relative to said main vertical columns between a retracted transport mode and an extended operating mode, and is capable of tensioning riser and vertical moorings, self floatation, and optional oil storage; and the weight and buoyancy of said main columns and said keel tank is adjustable to raise or lower the center of gravity (C.G.) of the entire mass of the structure with respect to its center of buoyancy (C.B.) according to ballast and variable or fixed loads including deck payloads, to stabilize the structure, and to compensate for different operational, environmental, survival and installation stages of the structure.

11. The column-stabilized offshore floating platform structure according to claim 10, wherein said upper lateral truss members are secured horizontally between upper ends of adjacent said main vertical columns on three sides of said platform structure defining a wide an opening between two laterally adjacent said main vertical columns of sufficient width to accommodate at least a portion of a barge.

12. The column-stabilized offshore floating platform structure according to claim 10, wherein said main vertical columns have a generally rectangular cross section with short horizontal lateral extensions at their lower ends facing in opposed relation, and said lower lateral truss members extend horizontally between the extensions at the lower end of said main vertical columns connecting the adjacent main vertical columns.

13. A mobile column-stabilized floating offshore platform structure, comprising:

at least four spaced apart buoyant main vertical columns enclosed at top and bottom ends capable of being ballasted and de-ballasted defining four opposed sides of the platform structure;

lower lateral truss members formed of cross-braced tubular members secured horizontally between lower ends of adjacent said main vertical columns and interconnecting lower ends of said main vertical columns together in spaced apart relation on four sides of said platform structure to provide a pin connection that transfers axial and shear forces between said main columns; and upper lateral truss members formed of cross-braced tubular members secured horizontally between upper ends of adjacent said main vertical columns on three sides of said platform structure defining an opening between two laterally adjacent said main vertical columns of sufficient width to accommodate at least a portion of a barge, and said upper lateral truss members interconnecting the upper ends of said main vertical columns together in spaced apart relation to provide a moment connection that transfers moment as well as axial and shear forces between said main columns; wherein the weight and buoyancy of said main columns is adjustable to raise or lower the center of gravity (C.G.) of the entire mass of the structure with respect to its center of buoyancy (C.B.) according to ballast and variable or fixed loads including deck payloads, to stabilize the structure, and to compensate for different operational, environmental, survival and installation stages of the structure.

14. The column-stabilized offshore floating platform structure according to claim 13, wherein said main vertical columns have a generally rectangular cross section with horizontal lateral extensions at their lower ends facing in opposed relation, and said lower lateral truss members extend horizontally between the extensions at the lower end of said main vertical columns connecting the adjacent main vertical columns.

15. A method of transporting, deploying and installing a mobile offshore floating platform structure at an operating site, the platform structure including at least four spaced apart buoyant main vertical columns interconnected together in spaced relation at a lower end by lateral truss members on four sides of the platform structure, a buoyant deck mount structure secured to an upper end of each of said main vertical columns for receiving and supporting a deck, smaller cylindrical vertical columns each telescopically mounted in a respective main vertical column; and a buoyant keel tank secured to a lower end of the cylindrical vertical columns capable of retraction and extension relative to the main vertical columns; the method comprising the steps of:

floating the platform in water by the keel tank with the keel tank retracted;

lifting the platform onto the deck of a transportation barge, and transporting it to an operating site;

adjusting the ballast of the barge to lower the barge deck a sufficient distance such that the platform is free floating on the retracted keel tank at the operating site and thereafter moving the barge away from the floating platform;

adjusting the ballast of the keel tank to place the keel tank at fully extended distance beneath the main vertical columns;

releasably locking the keel tank at the fully extended distance;

maintaining the floating platform in a position relative to a subsea well head; and adjusting the ballast of the keel tank to place the deck mount structure a distance above the water surface for installation of a platform deck.

16. The method according to claim 15, wherein said a buoyant deck mount structure is a generally C-shaped or U-shaped structure having three generally rectangular sides secured to an upper end of each of said main vertical columns defining an opening between two laterally adjacent said main vertical columns of sufficient width to accommodate at least a portion of a barge; and including the further steps of:

transporting a platform deck to the operation site on the deck of a barge;

positioning the deck of the barge within the open side of the C-shaped or U-shaped deck mount structure such that the platform deck is disposed over the deck mount structure;

adjusting the ballast of the barge and the keel tank such that the platform deck is supported in a mating position only on the deck mount structure of the platform; and moving the barge out from the open side of the deck mount structure.

17. The method according to claim 15, wherein said step of releasably locking the keel tank at the fully extended distance comprises locking the cylindrical vertical columns to prevent telescoping movement relative to the main vertical columns.

18. The method according to claim 15, wherein said step of releasably locking the keel tank at the fully extended distance comprises installing braces between lower ends of the main vertical columns and the keel tank.

19. The method according to claim 18, wherein said keel tank includes a plurality of braces rotatably each mounted at one end on the keel tank and stowed horizontally thereon and having an opposed free end; and said step of releasably installing said braces comprises lifting and releasably connecting the free end to the lower end of respective main vertical columns.

20. A method of transporting, deploying and installing a mobile offshore floating platform structure at an operating site, the platform structure including at least four spaced apart buoyant main vertical columns interconnected together in spaced relation at a lower end by lateral truss members on four sides of the platform structure, tendon connectors on the lower ends of the main vertical columns; and a buoyant deck mount structure secured to an upper end of each of said main vertical columns for receiving and supporting a deck, the method comprising the steps of:

floating the platform in water in an inverted position with the buoyant deck mount structure oriented downward;

lifting the inverted platform onto the deck of a transportation barge, and transporting it to an operating site;

adjusting the ballast of the barge to lower the barge deck a sufficient distance such that the inverted platform is free floating on the buoyant deck mount structure at the operating site and thereafter moving the barge away from the floating platform;

maintaining the floating platform in a position relative to a subsea well head.

upending the platform and adjusting the ballast of the main vertical columns such that the deck mount structure is topside and the main columns are partially submerged;

maintaining the floating platform in a position relative to a subsea well head; and adjusting the ballast of the main vertical columns to place the deck mount structure a distance above the water surface for installation of a platform deck.

21. The method according to claim 20, wherein said a buoyant deck mount structure is a generally C-shaped or U-shaped structure having three generally rectangular sides secured to an upper end of each of said main vertical columns defining an opening between two laterally adjacent said main vertical columns of sufficient width to accommodate at least a portion of a barge; and including the further steps of:

transporting a platform deck to the operation site on the deck of a barge;

positioning the deck of the barge within the open side of the C-shaped or U-shaped deck mount structure such that the platform deck is disposed over the deck mount structure;

adjusting the ballast of the barge and the main columns such that the platform deck is supported in a mating position only on the deck mount structure of the platform; and moving the barge out from the open side of the deck mount structure.

22. The method according to claim 21, including the further steps of:

adjusting the ballast of the main vertical columns to place the tendon connectors at depth for connecting tendons anchored at a lower end to the seabed;

connecting upper ends of the tendons to the tendon connectors on the main vertical columns; and adjusting the buoyancy of the main vertical columns to obtain a tension load on the tendons and freeboard of the columns, as needed.

* * * * *